United States Patent [19]

Morel

[11] 4,208,769

[45] Jun. 24, 1980

[54] BREAKING MACHINE

[75] Inventor: André Morel, Cours la Ville, France

[73] Assignee: Constructions Mecaniques F. Laroche et Fils, Cours la Ville, France

[21] Appl. No.: 906,776

[22] Filed: May 17, 1978

Related U.S. Application Data

[63] Continuation of Ser. No. 832,552, Sep. 12, 1977, abandoned, which is a continuation of Ser. No. 664,138, Mar. 5, 1976, abandoned.

[51] Int. Cl.[2] ..... D01G 9/16

[52] U.S. Cl. ..... 19/204; 19/86; 19/107

[58] Field of Search ..... 19/86, 88, 89, 66 CC, 19/98, 107, 204, 205; 169/9, 61, 65

[56] References Cited

U.S. PATENT DOCUMENTS

| | | | |
|---|---|---|---|
| 700,164 | 5/1902 | Andette | 19/98 |
| 700,347 | 5/1902 | Lumpkin | 19/66 CC |
| 2,751,630 | 6/1956 | Bryant | 19/66 CC |
| 2,827,667 | 3/1958 | Moss | 19/205 X |
| 3,517,746 | 6/1970 | Balmes, Jr. | 169/9 |
| 3,949,812 | 4/1976 | Hay | 169/9 |

FOREIGN PATENT DOCUMENTS

| | | | |
|---|---|---|---|
| 78887 | 12/1894 | Fed. Rep. of Germany | 19/107 |
| 1268369 | 6/1961 | France | 19/107 |
| 510942 | 1/1955 | Italy | 19/88 |
| 506954 | 6/1939 | United Kingdom | 19/89 |
| 1113025 | 5/1968 | United Kingdom | 19/89 |

*Primary Examiner*—Louis Rimrodt
*Attorney, Agent, or Firm*—Remy J. VanOphem

[57] ABSTRACT

The breaking machine comprises a spiked drum mounted for rotation about a horizontal axis. A device feeds fibers to the drum. The feed device includes a horizontal roller of smaller diameter than that of the drum and is positioned laterally tangential to the drum. A device recycles insufficiently opened waste. A system forms the fibers into layers. A mechanism sharpens the spikes of the drum.

12 Claims, 11 Drawing Figures

4
29
33
32
30
31
28

8
48
47
6
49
43
44
50
9
52
51
7
53
55
46
45
4
54
63
42

BREAKING MACHINE

This is a continuation of application Ser. No. 832,552 filed Sept. 12, 1977, now abandoned, which is a continuation of application Ser. No. 664,138 filed Mar. 5, 1976, now abandoned.

FIELD OF THE INVENTION

The invention relates to breaking or opening machines, principally for the textile industry.

SUMMARY OF THE INVENTION

The machine may be constructed in a modular manner, that is to say composed of different parts which may be fitted together but remain independent.

The feed device may comprise a horizontal roller of which the exterior surface is made of rubber, this roller revolves around an axis which itself may be moved around a second axis parallel to it. A fixed cylindrical trough is provided below the roller tangentially to it, while adjustable resilient components keep the roller bearing on the trough according to a selected pressure by pivoting about the second axis in such a way that the material to be broken is fed towards the spiked drum as it passes between the trough and the roller due to the rotation of the roller.

According to a variant of the invention, the horizontal roller of the feed device is made from steel, either channeled or toothed. The roller revolves about a fixed axis. The device includes at least one lever pivoted about a horizontal axis, there being a resilient component which keeps this lever bearing on the lower part of the roller, in such a way as to constitute, by the juxtaposition of levers, a bearing surface extending over the entire length of the roller. The material to be broken is presented towards the spiked drum as it passes between the surface and the roller, owing to the rotation of the roller.

According to an alternative variant of the invention, the horizontal roller of the feed device comprises a channeled steel roller, and there is a second roller identical to the first roller. The second roller rotates about a fixed horizontal axis and is tangential to the spiked drum. One of the rollers is urged against the other in such a way that the two rollers turn in opposite directions and when rolling one on the other grip between them the material to be broken in order to present it towards the spiked drum.

The device for recycling waste which is insufficiently opened comprises two conveyer belts or aprons one above the other, the lower belt collecting at one of its ends the aforementioned waste on its upper run which is moving towards the opposite end against one end of the upper belt which thus in its turn picks up the waste to take it at its other end towards the feed device.

A suction system is provided, interposed at the end of the lower conveyer belt, so that the waste is picked up pneumatically so as to be taken out of the recycling if necessary.

There is provided, interposed in the path of the waste for recycling, a system with beating rollers for the separation of possible solid waste which is not breakable.

The system of beating rollers is fitted with a suction hopper which allows the waste to be picked up and carried pneumatically and the unbreakable waste to be separated.

The suction hopper of the beating roller system is mounted on a slide which allows its rapid replacement by grills, the choice of the adapted device thus varying in relation to the material to be broken.

The system for forming the fibers into layers comprises a perforated revolving drum of which the inner volume is kept at a low pressure so that the fibers are drawn by suction against the exterior face of the drum to a constant thickness, then are removed tangentially from the perforated drum forming a continuous regular layer.

The perforated drum is arranged to suck the fibers produced by the spiked drum by means of a passage of which the major cross-section is parallel to the axis of rotation of the spiked drum, this passage is fitted parallel to the said axis of rotation with a row of individually adjustable shoes capable of uncovering the air inlets in order to regulate the suction.

The sharpening mechanism of the spiked drum comprises a grinder with a cup wheel able to slide longitudinally on a slideway parallel to the axis of rotation of the spiked drum.

The anti-fire system comprises an assembly of powder extinguishers distributed inside a hood surrounding the spiked drum.

DETAILED DESCRIPTION OF PREFERRED EMBODIMENT

Figure 1:
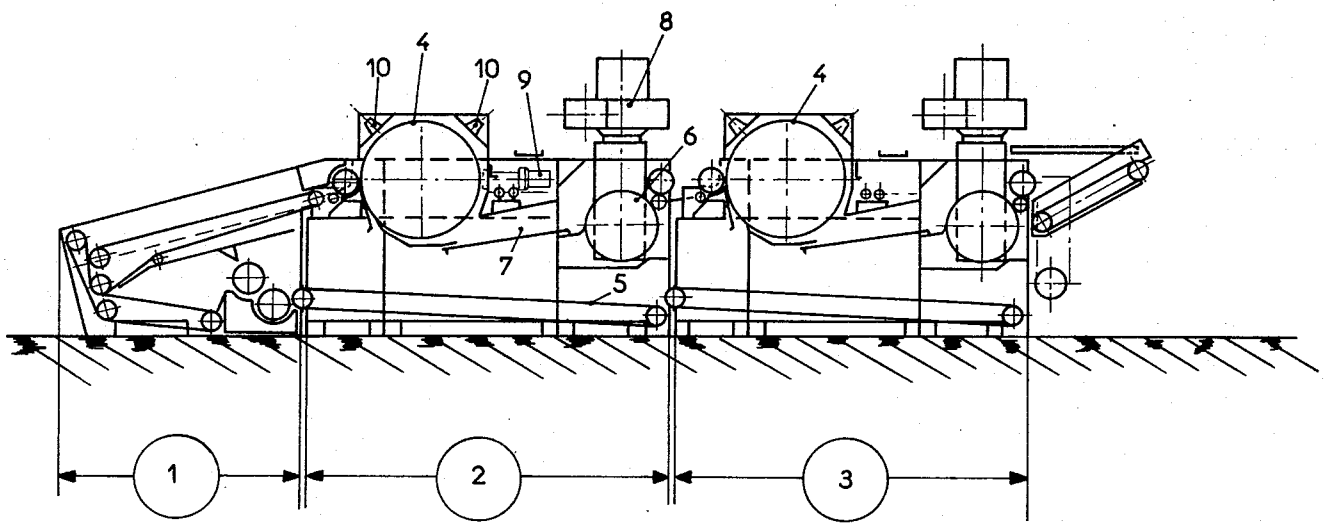
FIG. 1 is a longitudinal sectional view of the assembly of an embodiment of breaking machine according to the invention.

FIG. 1 shows a breaking machine according to the invention, composed of three juxtaposed independent modular assemblies 1, 2, and 3. Assembly 1 constitutes the feed conveyer. Each of the assemblies 2 and 3 comprises mainly: a spiked drum 4, a recycling conveyer 5, a perforated drum 6, a passage 7, a suction device 8 for layering the fibers, a sharpening mechanism 9, and several extinguishers 10.

Figure 2:
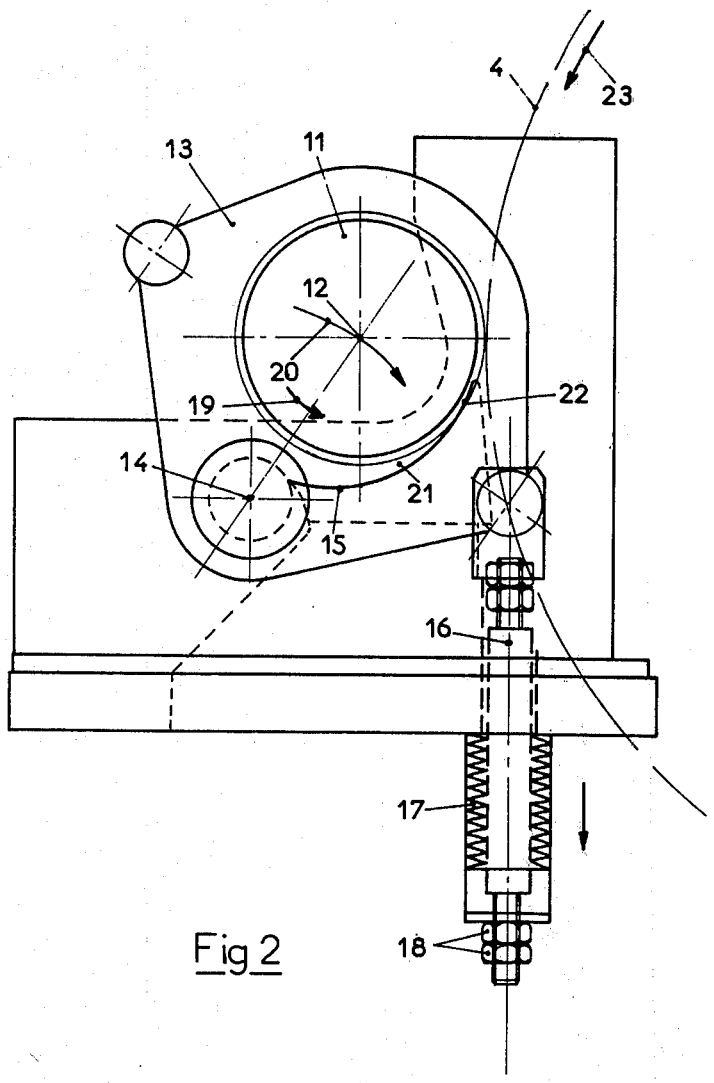
FIG. 2 is an enlarged portion of FIG. 1, showing the feed device of the machine.

The spiked drum 4 is of known type. It turns about a horizontal axis of rotation. A device for the feeding of materials toward the drum (FIG. 2) comprises a horizontal rubber roller 11 tangential to the drum. This roller turns around a shaft attached to a support 13. This support is itself pivoted on a shaft 14 attached to the frame of the machine. A fixed trough 15 of special profile is provided below the roller 11. Its profile is that of part of a cylinder with a radius of curvature greater than that of the roller. The cylinder is urged against the trough 15 by means of conical spring washers 17 stacked on a shaft 16 which is pivoted to the support 13.

The washers exercise between the support 13 and the frame a retraction force which is regulable owing to nuts 18 screwed onto the shaft 16.

The operation is as follows. The combination of the rotation 19 of the roller 11 and the pressure 20 which it exerts towards the trough 15 causes material to enter the space 21 included between this roller and the trough. On arriving at the narrow end 22 of the space 21 next to the spiked drum 4, this material remains partially trapped, while the portion of material which projects is broken by the spikes of the drum. This drum turns in the direction indicated by the arrow 23, with a speed of rotation greater than that of the roller 11. The elasticity of the rubber roller allows possible local differences in thickness of material to be compensated along the length of the roller and trough.

Figure 3:
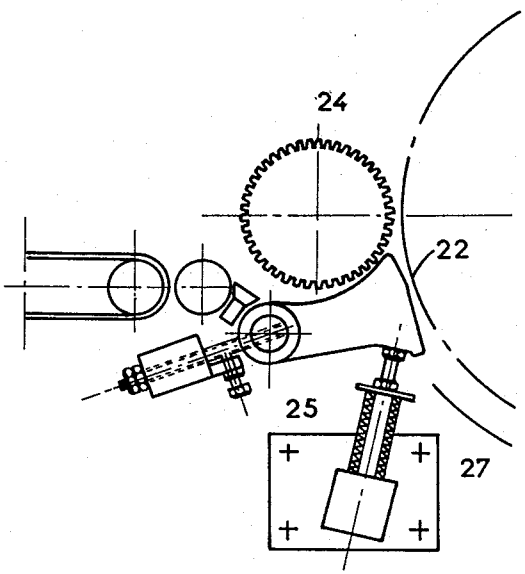
FIG. 3 is a view similar to FIG. 2, but showing an alternative feed device.
Figure 4:
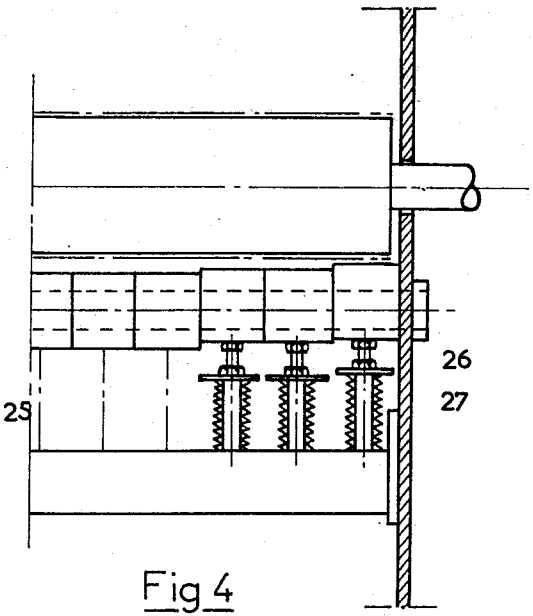
FIG. 4 is a section on line IV—IV of FIG. 3.

There is shown in FIGS. 3 and 4 an alternative form of feed device according to which the preceding roller 11 is replaced by a grooved steel roller 24 or by a toothed roller, that is to say a roller having axially extending teeth or ribs. The shaft of this roller is fixed and bearing on the underside of the roller along its entire length is a set of levers 25. Each lever is pivoted around a common horizontal shaft 26 but is fitted with an individual spring 27 which bears on the frame to keep the lever pressing against the roller 24.

The operation is similar to that of the preceding device, the advantage here being the independence of the levers, which allows large local differences in thickness of the material, nevertheless without any substantial risk of lessening the gripping force on the material.

Figure 5:
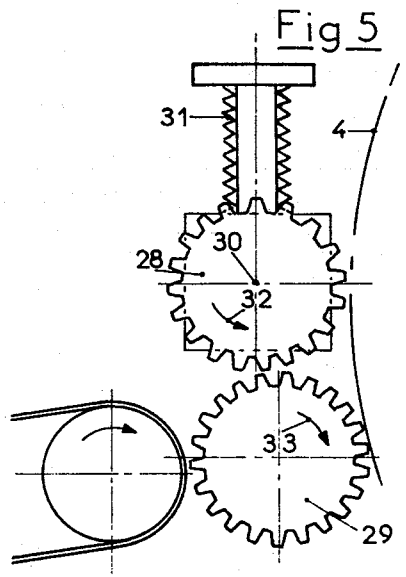
FIG. 5 shows a further feed device.

There is shown in FIG. 5 a further possible arrangement of feed device. Channeled or toothed rollers 28 and 29, are arranged tangentially to the drum 4 and to each other. The lower roller 29 rotates about a fixed shaft. The upper roller 28 rotates about a shaft 30 which is mounted on a support able to move vertically. A spring 31 allows a regulable force to be applied between the frame and the shaft 30 in such a way as to bring the rollers 28 and 29 together with regulable pressure.

The operation is as follows. The rollers 28 and 29 are given respective rotations 32 and 33, so that they roll one upon the other along their lines of contact. The material is introduced in such a way as to be inserted between them so that it is presented to the spikes of the drum while remaining still partially trapped between the two rollers. Thus, each variant of the feeding means comprises a guide means and roller with a spring means exerting a regulatable spring pressure urging the roller and guide means together to accommodate different material thicknesses.

Figure 6:
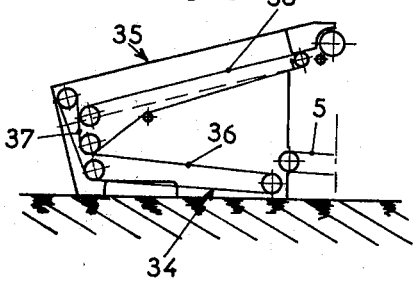
FIG. 6 is a portion of FIG. 1, showing the device for recycling waste.

There is shown in FIG. 6 a device for recycling waste comprising an upper conveyor belt 35 and lower conveyor belt 34, the lower belt 34 being adjustable and inclination for the purpose described below. The lower belt 34 is fed with insufficiently opened waste by the belt 5 which is partially shown. The upper face 36 of the belt 34 is inclined only slightly from the horizontal for the greater part of its run, then, towards its end, it rises almost vertically for a part 37 of the run which is common to the two belts of the conveyers. In this part 37, the belt of the conveyer 34 is applied against the start of the upper face 38 of the belt of the conveyer 35.

The operation is as follows. In the part 37, the waste previously lying on the face 36 is trapped between the belts of the two conveyers. On arriving at the level of the face 38 this waste is carried away by this face. The face 38 is at the same time used for the general feeding of material to the machine.

Figure 7:
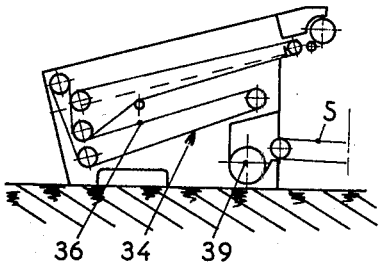
FIGS. 7 to 9 are views similar to FIG. 6, showing alternative embodiments of the recycling device.

There is shown in FIG. 7 the same arrangement but fitted with a suction device 39. For this, one end of the belt 34 has been raised while the suction device faces the end of belt 5.

The operation is the same as previously. The advantages which result from the suction device being inserted in the circuit is to eliminate waste which for certain materials is recognized as being unusable, hence of no value for recycling.

Figure 8:
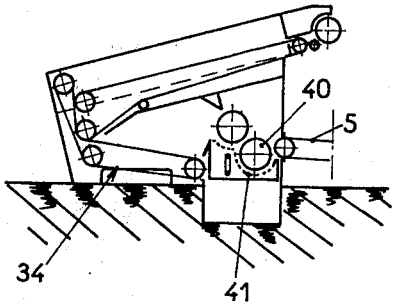
Figure 9:
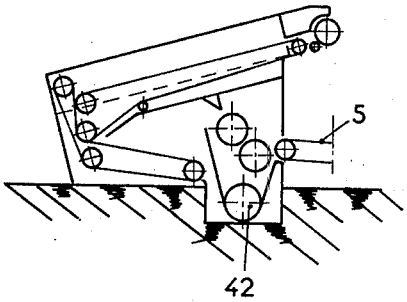

There is shown in FIG. 8 a system with beating rollers interposed between the conveyers 5 and 34 in the recycling circuit. This device likewise allows the elimination of certain unwanted particles. It is provided with grills 41, but these grills are fitted after the fashion of a drawer, and may be immediately replaced by a hopper 42 which allows pneumatic transfer of the waste (FIG. 9).

The suction device 39 and the beating rollers comprise a second separator means for separating waste from the recycling material conveyed back to the feed.

Figure 10:
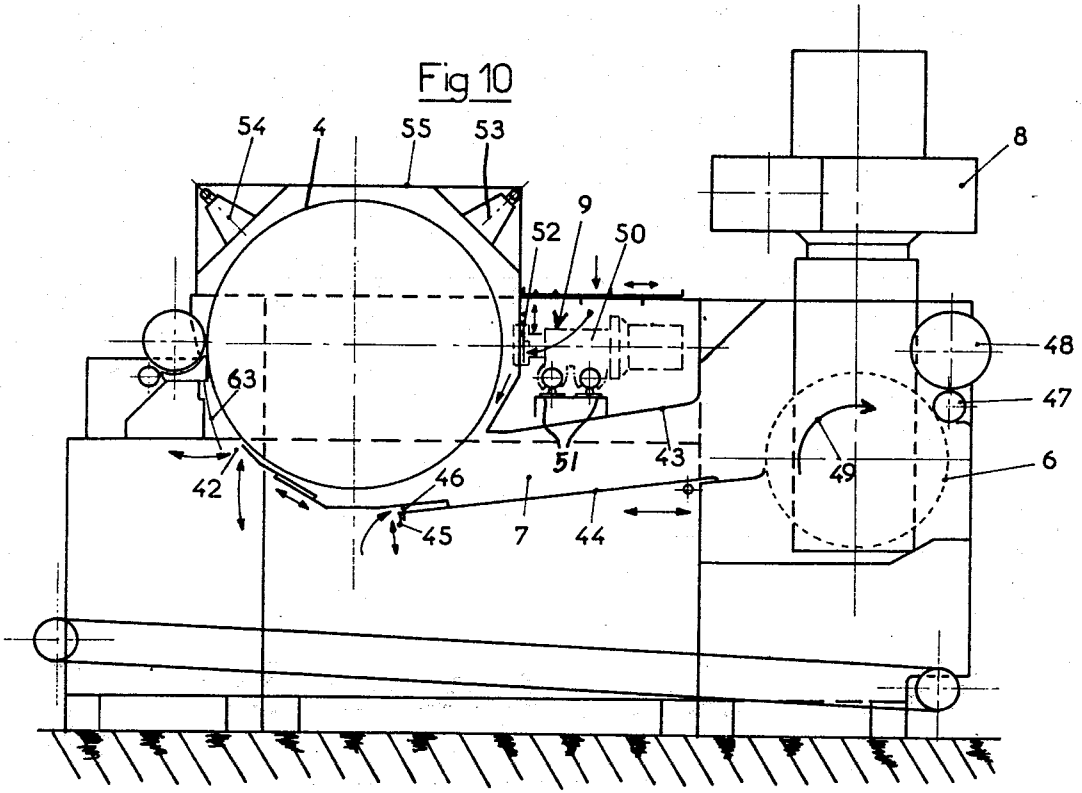
FIG. 10 is an enlarged portion of FIG. 1, showing principally the system for layering and the sharpening device.
Figure 11:
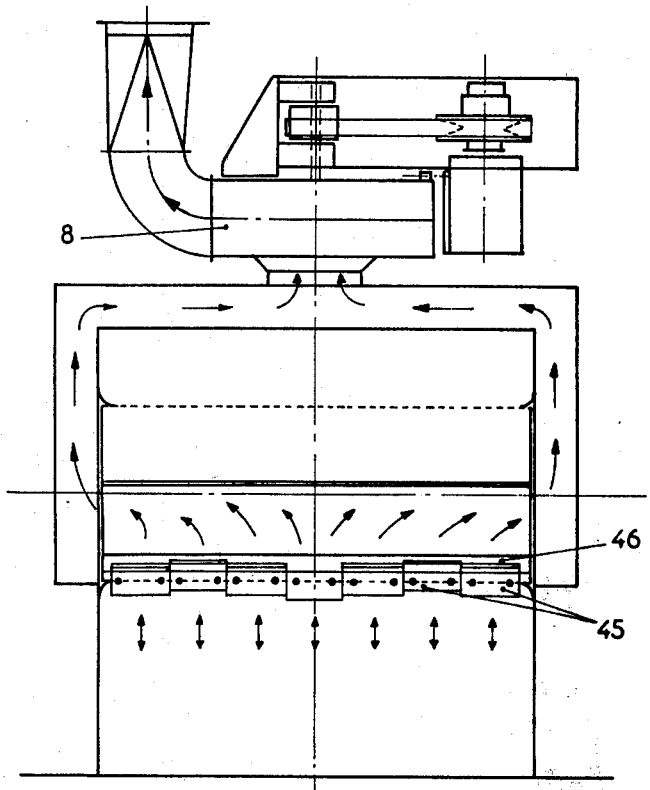
FIG. 11 is a section on the line XI—XI of FIG. 10, showing the layering system.

There is shown in FIGS. 10 and 11 the system for the layering of the fibers which comprises the first separator means. The fibers detached by the spikes of the drum 4 pass directly, if they are too big, hence insufficiently opened, through an opening 42 adjusted by a deflector 63. For the others a suction passage 7 is provided. This passage is defined between an upper metal sheet 43 and a lower metal sheet 44 and stretches across the full width of the drum 4. The lower sheet 44 is fitted with a row of shoes 45 aligned parallel to the axis of the drum. These shoes may be moved in a vertical plane so that they can uncover to a greater or lesser degree air inlet openings 46. The passage 7 opens onto the outer surface of a perforated drum 6. This drum is able to turn about its axis of rotation which is arranged parallel to that of the drum 4. Its interior volume opens at its two ends on suction conduits connected to the upper suction device 8. A roller 47 is placed tangential to the perforated drum 6. This roller 47 is itself rolling against a drum 48.

The operation is as follows. The suction device 8 is the start of a circulation of air which goes from the exterior to the interior of the perforated drum 6. This air passes around the spiked drum 4, then through the passage 7, and is charged with fibers in suspension. The holes in the drum allow the air to pass but do not allow the fibers to pass; the latter then accumulate on the exterior surface of the drum. This drum, which turns in the direction 49, carried the fibers which are thus accumulated to penetrate between the roller 47 and the drum 48. The independent control of the shoes 45 allows the suction to be regulated across the full width of the machine, so that the roller 47 and the drum 48 supply a regular continuous layer of fibers.

The sharpening mechanism 9 shown in FIG. 10 is constituted by a grinder 50 movable along two rails 51 parallel to the axis of the spiked drum in such a way as to be able to travel across the full width of the drum. This grinder carries a cup wheel 52 tangential to the drum 4. By moving the grinder longitudinally at the same time as the drum 4 revolves, it is possible to carry out a rapid grinding of the spike tips.

An anti-fire system is likewise provided. This system is constituted by an assembly of powder extinguishers, such as 53 and 54, carefully distributed on the inside of a hood 55 which encloses the drum 4 on its upper side (FIG. 10).

What is claimed is:

1. A modular breaking machine comprising at least one feed conveyor module and at least one separator module connectable in series with said feed conveyor modules each of said separator modules comprising:

a spiked drum rotatably driven about an axis of rotation to open fibers;

feeding means for feeding fibers to be opened to said spiked drum including a rotatable roller and guide means defining a space between said rotatable roller and said guide means and further including spring means urging said roller and said guide means into engagement with a regulatable spring pressure;

first separator means receiving the fibers opened by said spiked drum for separating the insufficiently opened fiber unusable waste and unbreakable waste from the sufficiently opened fibers;

a recycling conveyor receiving the insufficiently opened fibers and said unusable and unbreakable waste for transporting them to said feed conveyor;

means for receiving the sufficiently opened fibers from said spiked drum, said receiving means forming said sufficiently opened fibers into layers;

said at least one feed conveyor module further comprising a lower conveyor means for transporting said insufficiently broken fibers received from said recycling conveyor of said separator module to said separator module feed means.

2. The breaking machine of claim 1 wherein, said roller comprises:

a rubber roller revolving about an axis parallel to said axis of rotation of said spiked drum;

said guide means comprises a concave trough having an input end, and a radius greater than the radius of said roller, said trough disposed below said roller with its output end tangential to said roller and said spiked drum and having its input end separated from said roller;

said spring means includes support means, pivotally supporting said roller about a second axis parallel to said first axis, said support means resiliently urging said roller against said trough.

3. The breaking machine of claim 1 wherein, said roller comprises:

a horizontal roller having a serrated surface disposed tangential to said spiked drum and rotating about a fixed axis of rotation parallel to said horizontal axis; and said guide means extends the full width of the roller for guiding the fibers between said roller and spiked drum, said guide means having plurality of levers, each lever being pivotally mounted from a common horizontal axis, and each lever being resiliently urged against said roller by said spring means.

4. The breaking machine of claim 1 wherein, said feed conveyor module includes an upper conveyor and a lower conveyor, said lower conveyor having a first section running generally horizontal and a second section running generally vertical;

said upper conveyor having a first section running in a generally vertical direction tangential to the second section of said lower conveyor and having a second section running in a generally horizontal direction delivering said insufficiently broken fibers to said feed means, wherein the fibers carried along on the first section of said lower conveyor are trapped between the second section of said lower conveyor and the first section of said upper conveyor and carried upward and deposited on the second section of said upper conveyor.

5. The breaking machine of claim 4 wherein said interchangeable separating means is a suction means adapted to be fitted between said upper and lower conveyor, said suction means receiving the unusable waste from the recycling conveyor and depositing said waste in waste storage.

6. The breaking machine of claim 4 wherein said interchangeable separator means is a set of beating rollers and grills adapted to be interposed between said upper and lower conveyor, said beating rollers and grills separating the unbreakable waste from the insufficiently opened waste and transferring only said insufficiently open fibers to said lower conveyor.

7. The breaking machine of claim 4 wherein said interchangeable separator means comprises:

beating rollers for separating the unbreakable waste from the insufficiently broken fibers and a suction means for carrying the unbreakable waste away, said beating rollers and suction means being adapted to be interposed between said upper and lower conveyor.

8. The breaking machine of claim 1 wherein, said means for forming fibers into layers comprises a perforated drum having a perforated cylindrical surface rotating about an axis;

a passageway between said spiked drum and said perforated drum;

suction means exhausting the interior of said perforated drum so that the fibers suspended in the air in the passageway are drawn against said perforated surface in a layer of regular thickness; and means for tangentially removing the fiber layer from said perforated drum.

9. The breaking machine of claim 8 wherein, said passageway has a rectangular configuration with its longer sides parallel to said horizontal axis, said passageway further includes a plurality of adjustable air inlet apertures to regularize the air flow in the passage caused by the suction means exhausting the perforated cylinder.

10. The breaking machine of claim 1 wherein, said breaking machine further includes a hood generally surrounding said spike drum.

11. The breaking machine of claim 1 further including means for sharpening said spikes of said spiked drum and anti-fire means arranged in the proximity of said spiked drum.

12. The breaking machine according to claim 1 wherein said at least one feed conveyor module further comprises:

second separator means interposed said recycling conveyor and said feed conveyor for removing different kinds of non-recyclable waste; and means for adjusting said feed conveyor to accommodate said second separator means.

* * * * *

UNITED STATES PATENT AND TRADEMARK OFFICE

CERTIFICATE OF CORRECTION

PATENT NO. : 4,208,769
DATED : June 24, 1980
INVENTOR(S) : Andre Morel

It is certified that error appears in the above-identified patent and that said Letters Patent are hereby corrected as shown below:

Column 2, line 60, after the numeral "11" insert

----laterally----.

Signed and Sealed this

*Twenty-eighth* Day of *October 1980*

[SEAL]

*Attest:*

SIDNEY A. DIAMOND

*Attesting Officer*

*Commissioner of Patents and Trademarks*